United States Patent [19]

Zeloyle

[11] 4,008,935

[45] Feb. 22, 1977

[54] STAND FOR A PROJECTED IMAGE VIEWING APPARATUS

[75] Inventor: Daniel J. Zeloyle, New Kensington, Pa.

[73] Assignee: Burrell Industrial Supply Company, New Kensington, Pa.

[22] Filed: June 2, 1975

[21] Appl. No.: 582,988

[52] U.S. Cl. ..... 312/252; 312/234; 312/278; D6/186

[51] Int. Cl.[2] ..... A47B 81/00

[58] Field of Search ..... 312/252, 234, 278; 248/11, 441; 40/129 R; D6/186

[56] References Cited

UNITED STATES PATENTS

| | | | |
|---|---|---|---|
| 236,685 | 1/1881 | Massey | 248/441 |
| 727,166 | 5/1903 | Harrison et al. | 312/234 |
| 1,590,520 | 6/1926 | Jones | 248/441 |
| 3,667,826 | 6/1972 | Wood et al. | 312/278 |
| D109,295 | 4/1938 | Erickson | D6/186 |
| D115,104 | 6/1939 | Erickson | D6/186 |
| D142,525 | 10/1945 | Myers | D6/186 |

*Primary Examiner*—Paul R. Gilliam
*Assistant Examiner*—Victor N. Sakran

[57] ABSTRACT

A stand for a project image viewing apparatus adapted to fixedly maintain the plane of the projected image display screen at an angle inclined rearwardly about 30° from the vertical and to maintain the display screen below the horizontal plane extending through the eye level of an observer seated in front of the image viewing apparatus.

3 Claims, 2 Drawing Figures

STAND FOR A PROJECTED IMAGE VIEWING APPARATUS

FIELD OF THE INVENTION

The present invention relates to a stand for a projected image viewing apparatus, particularly a microfilm reader, adapted to fixedly maintain the plane of the projected image display screen of said projected image viewing apparatus at an angle inclined rearwardly about 30° from the vertical and to maintain the display screen below the horizontal plane extending through the eye level of an observer seated in front of said image viewing apparatus in a standard chair having a seat height of about 16 to about 20 inches.

DESCRIPTION OF THE PRIOR ART

It is old to project an optical image in magnified form onto a viewing screen. Such devices, commonly referred to as an image viewing apparatus, are normally mounted on a table provided with a horizontal support at an elevation such that when seated before said image viewing apparatus an observer must maintain his head in a substantially vertical plane and his line of sight in a substantially horizontal plane in order to fully observe the image on said display screen. However, normally a person inclines his head slightly forwardly and his line of sight extends downwardly in a plane somewhat below the horizontal. Accordingly, when an observer must maintain his head and his line of sight in an unnatural position for an extended period of time his neck muscles and his eyes are severely strained, he becomes quickly fatigued and his powers of observation drop off at an alarming rate.

SUMMARY OF THE INVENTION

The device described and claimed herein provides a means for maintaining an image viewing apparatus in fixed position so that an observer sitting before the same can view the screen of said apparatus in a natural position over a long period of time without experiencing any appreciable fatigue or discomfort.

BRIEF DESCRIPTION OF THE DRAWING

Referring to FIG. 1, reference numeral 2 defines an image viewing apparatus provided with a display screen 6 normally mounted on a table for viewing by an observer 4 sitting in front of said device. The difficulties attending the use of said device when so positioned have been set forth above.

Figure 1:
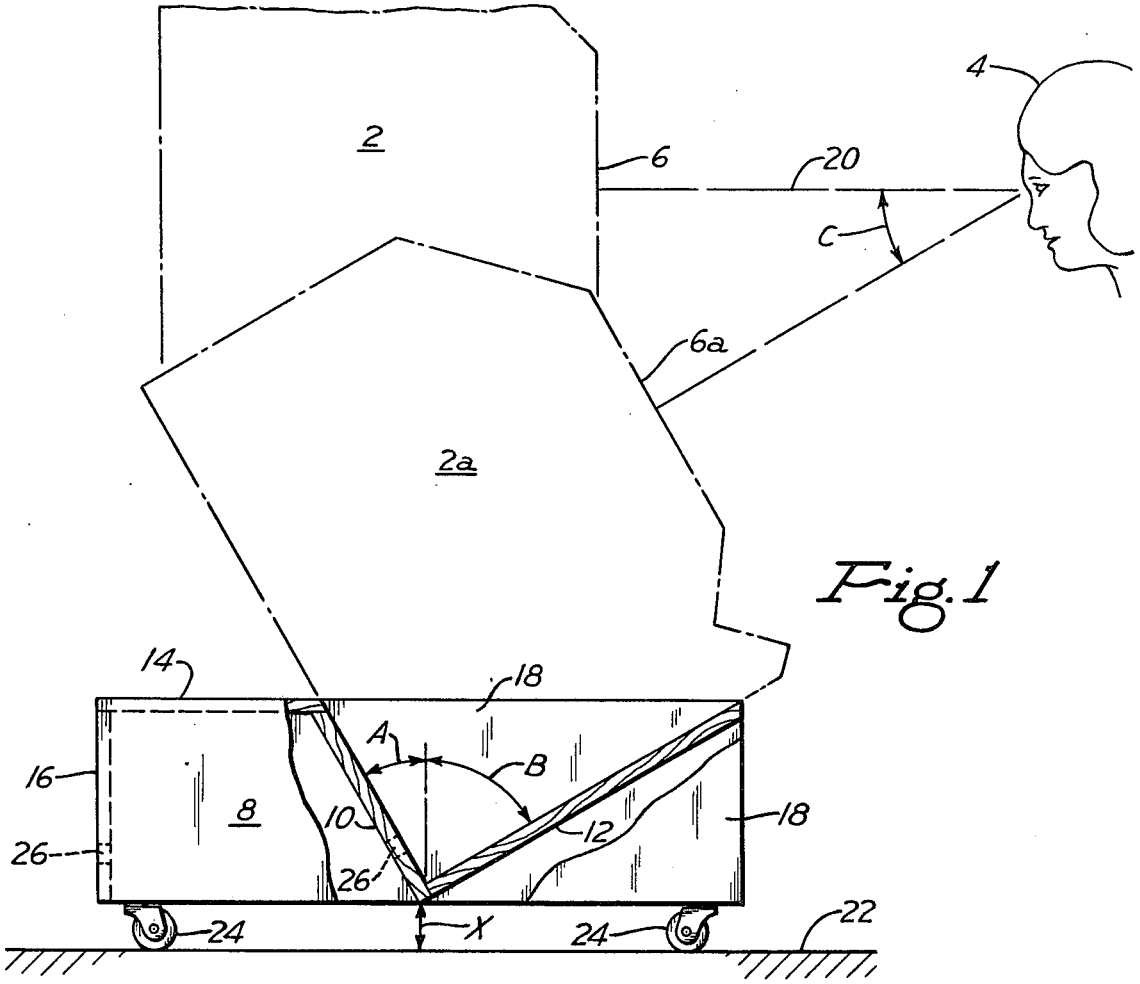
FIG. 1 is a side view, with portions broken away, of an image viewing apparatus mounted on a stand in accordance with a preferred embodiment of my invention.
Figure 2:
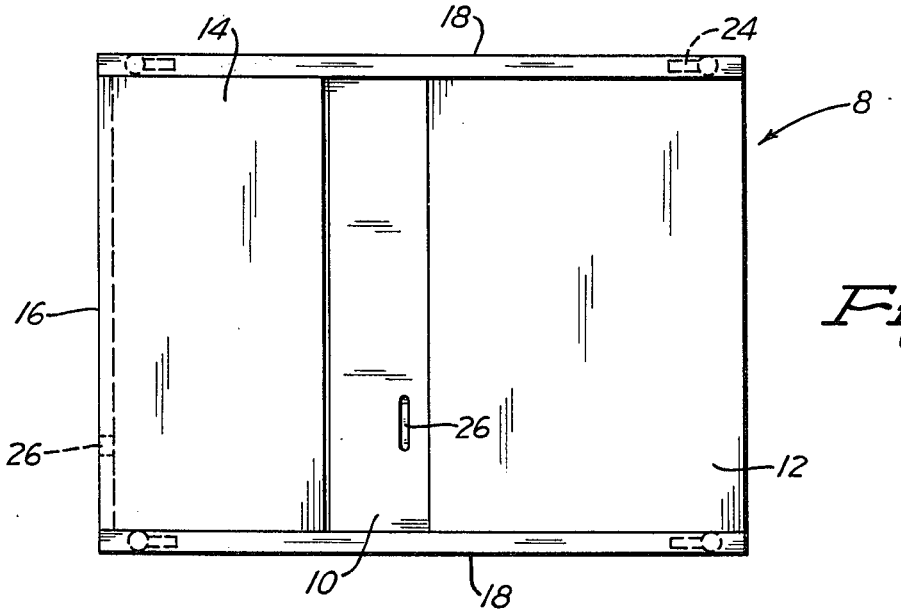
FIG. 2 is a plan or top view of the stand of FIG. 1.

The unique stand or carrel 8 provided herein for maintaining the image viewing apparatus in a fixed position easily overcomes the above difficulties. The stand consists essentially of a first flat laterally disposed member 10 inclined rearwardly at an angle A of about 30° from the vertical, a second flat laterally disposed member 12 inclined forwardly at an angle B of about 60° from the vertical means to maintain said members in a selected fixed position and a top portion 14. The lower edges of said members 10 and 12 are positioned coextensively adjacent each other and substantially parallel to the floor and, in the preferred embodiment illustrated in FIG. 1, are integrally attached to each other by any convenient or suitable means. It can be seen that when image viewing apparatus 2*a* is mounted in position the flat laterally disposed member 10 will support the back of said image viewing apparatus and the flat laterally disposed member 12 will support the base of said image viewing apparatus.

Any suitable means can be used to support said laterally disposed members in the defined position. In the preferred embodiment, illustrated in FIG. 1, said laterally disposed members are integral with, and from a recessed portion of, a stand 8, provided with rear bracing member 16 and side bracing members 18. In this preferred embodiment the image viewing apparatus fits snugly into place and is not easily moved out of the desired viewing position. The stand 8 can be made of any suitable material, such as wood, metal, etc.

It is imperative, for reasons that will be forth below, that the unique stand herein be designed so that when the image viewing apparatus is mounted thereon the viewing screen 6*a* thereof be below the horizontal plane 20 extending through the eye level of an observer 4 sitting in front of said apparatus. This requirement can be met by maintaining the lower adjacent edges of said members 10 and 12 at a distance X not to exceed about 12 inches above the supporting floor 22, preferably about 2 to about 4 inches above floor 22. To help maintain said laterally disposed members 10 and 12 at said selected level above the floor and/or to render the stand 8 moveable, the same can be provided with casters or rollers 24. Laterally disposed member 10 and rear bracing member 16 can be provided with openings 26 therein to permit electrical wiring connection between the projected image viewing apparatus and an electrical source.

The advantages afforded by the novel stand described and claimed herein is apparent by reference to FIG. 1 wherein an observer is seated in front of an image viewing apparatus 2*a* mounted on said novel stand 8. As shown, when so seated the observer's head is normally tilted slightly downwardly so that the observer's line of sight is inclined at an angle C about 30° from the horizontal. Since the screen 6*a* is normally substantially parallel to the back of said image viewing device and to said laterally disposed member 10, screen 6 is therefore also inclined rearwardly about 30° from the vertical. Also, as shown, screen 6*a* is located below the horizontal plane 20 extending through the eye level of observer 4. Under such circumstances it is apparent that the observer's line of sight is perpendicular to the plane of screen 6*a*. Accordingly, since the observer's head and eyes rest normally and the viewing surface is in direct line of vision, it follows that the observer can view the screen 6*a* over an extended period of time without experiencing undue physical fatigue. This arrangement is particularly beneficial to an observer wearing bifocal lens, since such lens are generally designed to be viewed through the lower portion of the glass.

The height at which the novel stand must maintain the image viewing apparatus and the angle of inclination of said laterally disposed members 10 and 12 are obviously dependent upon many parameters. Thus the height that the novel stand herein must maintain the image viewing apparatus will vary, of course, with the size of the image viewing apparatus and the location and inclination of screen 6*a* thereon. With a relatively large image viewing apparatus and/or screen the stand will hold the same in a higher relative position than when a relatively small image viewing apparatus is mounted thereon.

The various angles defined above for laterally disposed members 10 and 12 are based on the premise that the image viewing apparatus is rectangular in shape in a side view thereof, as shown, for example, in FIG. 1. Accordingly, in order to accommodate image viewing devices that depart somewhat from said rectangular configuration and in order to maintain a substantially perpendicular line of sight for an observer seated in front of said image viewing apparatus, it is understood that the defined angles of inclination for said laterally disposed members 10 and 12 can vary somewhat, for example, up to about ± 10°, but generally in the range of about ± 5°.

Obviously, many modifications and variations of the invention, as hereinabove set forth, can be made without departing from the spirit and scope thereof, and therefore only such limitations should be imposed as are indicated in the appended claims.

I claim:

1. In use with a projected image viewing apparatus of the type wherein there is provided a screen which displays a projected image thereon for viewing by an observer, a single stand adapted to support said image viewing apparatus which includes a single first flat laterally disposed member inclined rearwardly 20° – 40° from the vertical, a single second flat laterally disposed member inclined forwardly 50° – 70° from the vertical, the lower edges of said laterally disposed members being positioned coextensively adjacent each other, said first laterally disposed member adapted to support the back of said image viewing apparatus, while said second laterally disposed member adapted to support the base of said image viewing apparatus, and recessed support means to maintain said stand as an integral unit whereby said lower edges of said laterally disposed members are positioned at a predetermined height not to exceed 12 inches above said floor, said support means comprising back, front and side members integral with said flat laterally disposed members and provided with additional support means attached to said stand.

2. The stand of claim 1 wherein said lower edges of said laterally disposed members are positioned at a height of 2 to 4 inches above said floor.

3. The stand of claim 1 wherein said first and second flat laterally disposed members are inclined rearwardly and forwardly, respectively, at an angle of 30° and 60°, respectively.

* * * * *